United States Patent [19]

Niedecker

[11] 4,308,641

[45] * Jan. 5, 1982

[54] U-SHAPED CLIP MADE FROM STRIP MATERIAL

[76] Inventor: Herbert Niedecker, Am Ellerhang 6, Königstein 2, Fed. Rep. of Germany, 6240

[ * ] Notice: The portion of the term of this patent subsequent to May 6, 1997, has been disclaimed.

[21] Appl. No.: 75,372

[22] Filed: Sep. 13, 1979

Related U.S. Application Data

[63] Continuation-in-part of Ser. No. 931,717, Aug. 7, 1978, Pat. No. 4,200,962, which is a continuation-in-part of Ser. No. 766,416, Feb. 7, 1977, abandoned.

[30] Foreign Application Priority Data

Feb. 19, 1976 [DE] Fed. Rep. of Germany ..... 2606658

[51] Int. Cl.[3] ..... B65D 77/12

[52] U.S. Cl. ..... 24/30.5 W; 24/115 A; 229/65

[58] Field of Search ..... 24/30.5 W, 30.5 R, 115 A, 24/27, 20 R, 20 CW; 229/65; 52/86

[56] References Cited

U.S. PATENT DOCUMENTS

| | | | |
|---|---|---|---|
| 2,972,791 | 2/1961 | Kelem | 24/30.5 W |
| 3,363,628 | 1/1968 | Wood | 24/30.5 W |
| 3,369,277 | 2/1968 | Seitz, Jr. | 24/30.5 W |
| 3,541,647 | 11/1970 | Marietta, Jr. | 24/30.5 W |
| 3,902,288 | 9/1975 | Knudson | 52/86 |
| 4,200,962 | 5/1980 | Niedecker | 24/30.5 W |

FOREIGN PATENT DOCUMENTS

| | | | |
|---|---|---|---|
| 202057 | 7/1958 | Austria | 24/30.5 W |
| 1078495 | 9/1960 | Fed. Rep. of Germany | 24/30.5 |
| 1761616 | 7/1971 | Fed. Rep. of Germany | 24/30.5 W |
| 256532 | 8/1948 | Switzerland | 24/30.5 W |

*Primary Examiner*—Roy D. Frazier
*Assistant Examiner*—Peter A. Aschenbrenner
*Attorney, Agent, or Firm*—Sprung, Felfe, Horn, Lynch & Kramer

[57] ABSTRACT

In a U-shaped clip made from strip material and intended to close bags and flexible tubes, said clip comprising a web connecting two limbs having outwardly angled end lugs, the improvement which comprises forming the surface of the clip which is to engage a bag so as to provide elevated and depressed zones to grasp the bag more securely. The elevated and depressed portions can be established by forming longitudinal beads on the inside of the clip along the web and limbs or by forming longitudinal grooves on such inside.

6 Claims, 9 Drawing Figures

Figure 1A:
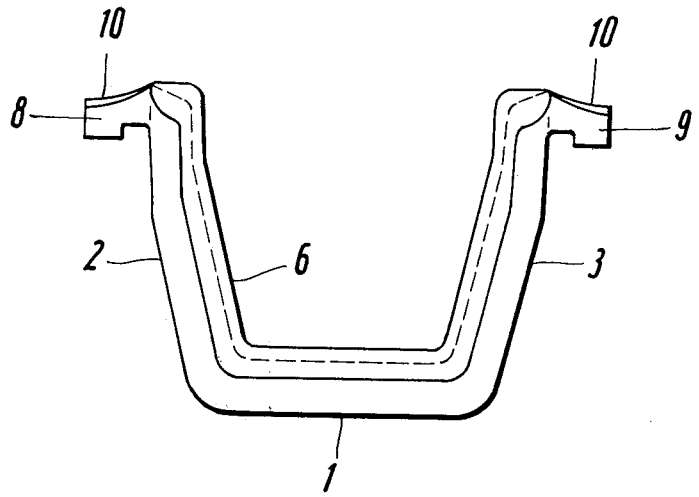

FIG. 4A
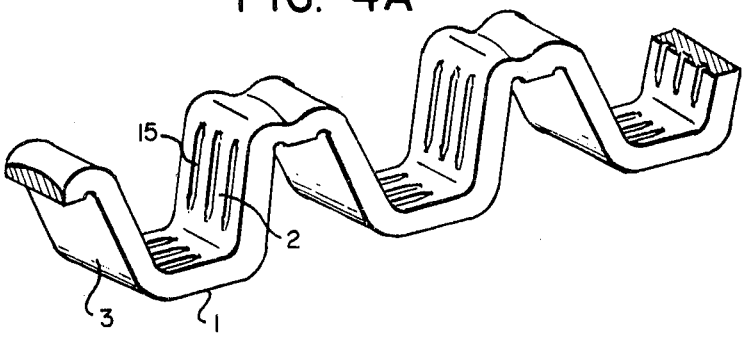
FIG. 4B
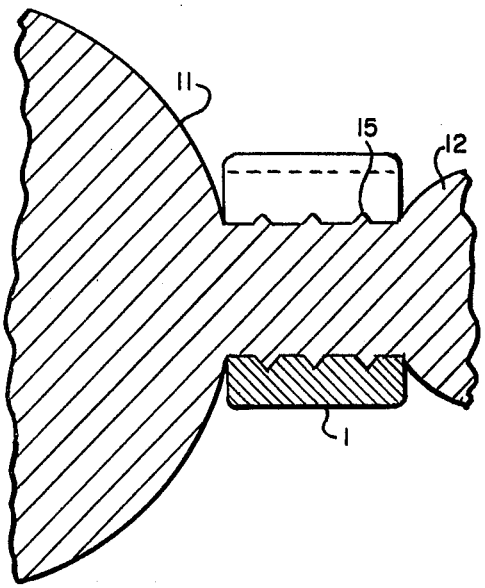
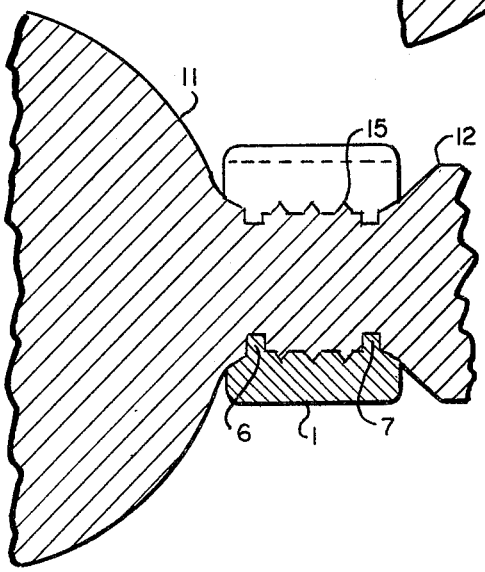
FIG. 5

U-SHAPED CLIP MADE FROM STRIP MATERIAL

This is a continuation-in-part of application Ser. No. 931,717, filed Aug. 7, 1978, now U.S. Pat. No. 4,200,962, which is a continuation-in-part of Application Ser. No. 766,416, filed Feb. 7, 1977, now abandoned.

This invention relates to a U-shaped clip which is made from strip material and intended to close bags and flexible tubes. These clips comprise a web and two limbs, which have outwardly angled end lugs by which each clip is easily separably connected to other clips in a strip (see German Patent Specification No. 1,078,495).

When a gathered end portion of a bag or flexible tube is to be closed by means of such clip, the web of the clip is first inserted into a suitable die so that the limbs extend upwardly, and the casing to be closed, which has usually a gathered end portion, is then inserted into the clip. A punch is subsequently moved toward the die to sever the clip from the strip and to close the clip (see German Patent Specification Nos. 1,078,495 and 1,761,616).

These clips made from strip material are used for flexible tubes in increasing sizes. In sausages which are large in diameter and which must be in a tightly filled condition when they have been closed, the content tending to expand exerts such a strong force that the clip can be pushed off the sausage end and the annular fastener applied to the joint may be expanded. Even stronger forces are exerted when the sausage is boiled. Sausages which are subsequently treated with air or smoke are hung in a smoking chamber. The hanger loop is hung into the open clip and is closed together with the clip. The weight of the sausage or the handling of the sausage by a smoking cart moving on uneven surfaces results in a tension which is exerted on the clip and tends to move it toward the end of the casing so that the clip can also be stripped from the sausage end in this case too. The force exerted by the content of the sausage as it tends to expand and the sliding of the clip on the end portion of the casing cause in most cases a fold of the casing to be driven into the joint. That fold acts like a wedge and urges the clip apart opposite to the direction in which it has been closed. Whereas it has been attempted to mitigate this disadvantage by the use of clips made from material which is larger in cross-section or from alloy material, each of these measures adds greatly to the costs of the clip, which involves in any case a large expenditure of material. It has also been attempted to apply a higher closing pressure in the closing machine so that the clip is firmly forced onto the gathered portion. This measure has the disadvantage that the present-day closing machines, which operate at a high speed, suffer heavy wear so that the machine must be repaired. Besides, the high closing pressure often results in damage to the casing. Excessively thick material has the further disadvantage that the outwardly angled limb ends have a large radius so that there is a larger wedge surface at the joint and the casing fold can act on a larger surface to drive the clip apart at the joint. It is also known to provide an inwardly directed middle rib (see Opened German Specification No. 1,761,616) for stretching the casing material adjacent to the last one-third of the length of the two limbs and of the adjoining limb end portions, which are angled outwardly. On the other hand, a clip made from thick material cannot be formed with a rib having the desired size because the strip must be as narrow as possible in order to save material and can be bent inwardly to form a rib only if the width and thickness of the strip are in a certain proportion. A narrow strip having a certain thickness cannot be bent inwardly to form a rib but in that case the rib will be struck from the body of the strip. It is an object of the invention to avoid the above-mentioned disadvantages.

Surprisingly it has been found that this object can be accomplished if the strip material is flanged inwardly wholly or in part at its outer edges to form beads longitudinal to the outer edges to the web and the limbs.

As a result, the clip is much stronger in that region which is to be stressed in flexure whereas there is no need for an additional expenditure of material and the width of the bearing area, which is important for the closing operation, is not reduced because the strip is flanged toward the inside of the strip only in part of its thickness. The clip is to be applied in such a manner that the inwardly extending beads are directed toward the bag or flexible tube where it is to be closed and do not only increase the flexural stiffness but oppose also a slipping of the clip. In the closed clip, the beads form two intensely clamping portions, which are axially spaced apart on the portion to be closed and the portion disposed between these beads exerts a smaller clamping force. In this way the seal is improved as by a labyrinth seal and a relative movement between the clip and the portion to be closed is largely eliminated. Owing to the improved seal, a lower closing pressure is sufficient so that the wear of the closing machines is reduced.

The strip material may be flanged in accordance with the invention by an upsetting operation if the beads are to be fairly rounded with a view to the intended use of the clip, or by a lancing operation if edged beads are desired which are particularly slip-proof, e.g., for use with delicate, smooth casings. The strip material is flanged after it has been formed into clips.

The strip material is desirably flanged beyond the bends between the limbs and the connecting lugs. In this case the lateral upsetting of the strip material to form the beads forces back the material which has been displaced outwardly at the bends so that an additional risk of injury is avoided and the strength at the bend is increased. Besides, the flanged beads form an annular surface so that only a relatively narrow indentation is formed between the closed limb end portions, and the risk that the clip is bent open by the pressure exerted by the content is reduced.

According to a preferred feature of the invention the connecting lug is additionally upset transversely to its longitudinal direction and is thus shaped into a dome. This feature ensures that the strip will be held together with the least expenditure of material and has at the portion to be severed such a sectional shape that it can easily be cut.

In combination, the features of the invention result in a clip which, for a given expenditure of material, exerts a much stronger closing force and is much more slip-proof, or a given closing function can be accomplished with an expenditure of material which is reduced by 25%.

Compared to the known clips made of strip material, the expenditure of material can be reduced and the resistance of the clips to slipping can be increased in that, in addition to or instead of the measures described hereinbefore, approximately parallel grooves are formed in the inside surface of the limbs and the web of the clip. These grooves result in a suction on the casing and thus improve the adhesion and slip resistance of the clip.

Figure 2:
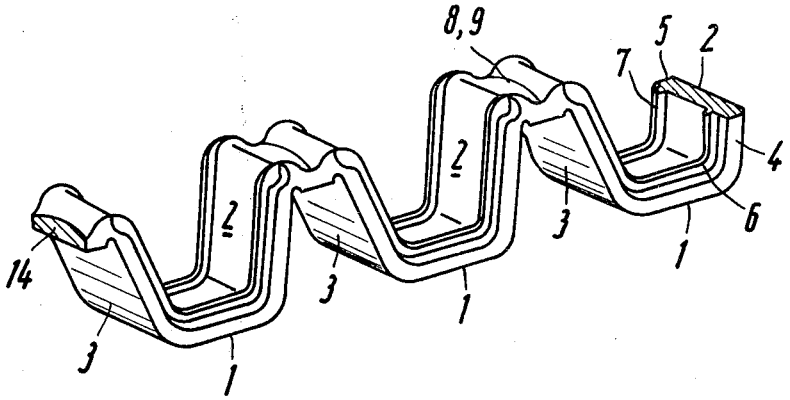
Figure 3A:
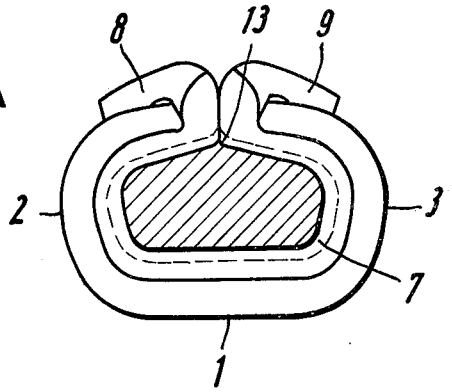

Further details and advantages of the clip according to the invention will be explained more fully with reference to an embodiment shown by way of example in the drawings, wherein;

FIGS. 1*a, b* and *c* show an individual clip according to the invention in two elevations and in section, respectively;

FIG. 2 shows a strip portion comprising a plurality of joined clips, in perspective;

FIGS. 3*a* and *b* show the clip in a closed state, in elevated and in section, respectively;

FIGS. 4*a* and *b* in section show a clip which is formed on the inside with grooves; and FIG. 5 in section shows a clip which is a composition of that of FIG. 1 and FIG. 4.

Figure 1B:
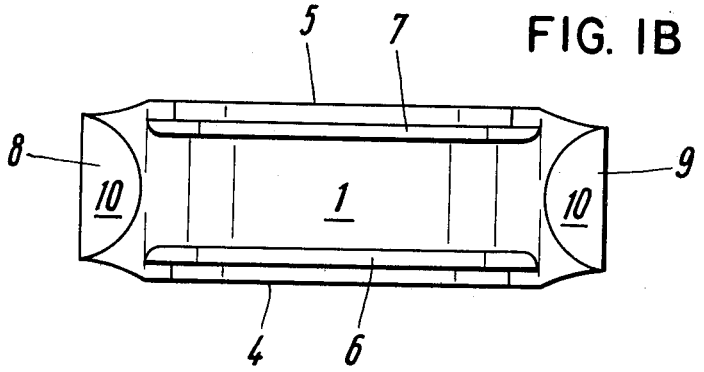

In FIGS. 1*a* and 1*b*, a clip according to the invention is seen in side elevation (FIG. 1*a*) and in an elevation viewed from its open end toward a web 1 of the clip (FIG. 1*b*). FIG. 1*a* shows a bead 6, which extends beyond the bend between the limbs 2, 3 into the region of the connecting lugs 8,9. It is apparent from FIG. 1*b* that the connecting lugs 8, 9 have been deformed in cross-section to have a domelike embossed portion 10.

Figure 1C:
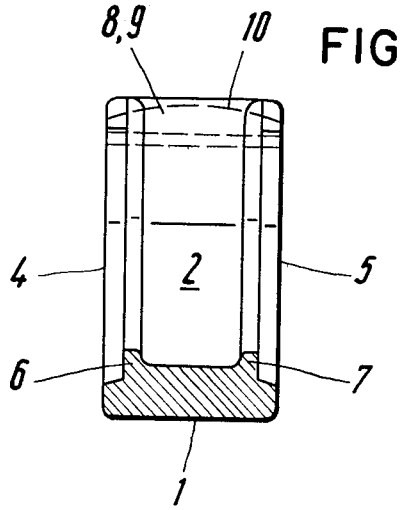

FIG. 1*c* shows a clip in a sectional view taken on a plane at right angles to the clip bottom 1. The limb 2 is seen in an elevation on its inside surface. Adjacent to the web 1 and the limb 2 of the clip, material has been displaced inwardly from the outer edges 4, 5 to form beads 6, 7 so that the previously rectangular cross-section of the clip has been changed into a section which is U-shaped on the inside. The clip is flanged only in that portion of its thickness which is disposed near the inside of the clip so that the width of the bearing surface required for the closing operation is preserved. The beads 6, 7 of the closed clip have been forced into the closed portion of the casing and exert a high pressure thereon and thus ensure a tight and slip-proof closure. The connecting lug 8, 9 which has domelike portion 10, in accordance with a preferred feature of the invention, is indicated by dotted lines in FIG. 1*c*.

FIG. 2 is a perspective view showing three joined clips. The strip is terminated at its right-hand end by a cut taken through the limb 2 and at its left-hand end by a cut taken through the usual point of severance 14. It is apparent how the clips have been shaped from strip material. The limb 2 is succeeded by the web 1, which is followed by the limb 3, the connecting lugs 8, 9, a limb 2, a web 1, etc. In this view, the shape of the beads 6, 7, which have been formed in accordance with the invention in that the outer edges 4, 5 have been flanged inwardly, is particularly well apparent.

Figure 3B:
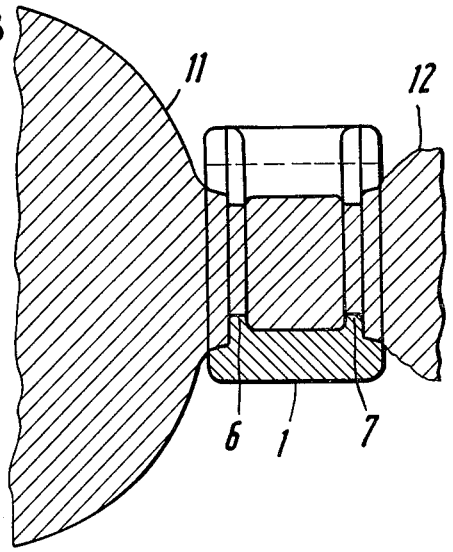

FIG. 3*a* is a transverse sectional view showing the closed portion. It is apparent that the flanged beads 6, 7 form an annular surface so that the indentation 13 is only very small and a substantial wedge area for engagement by a casing fold is not provided. It is also apparent that the connecting lugs 8 and 9 are in snug engagement. It is apparent from FIG. 3*b* that the sausage 11 is particularly tightly sealed at its free end 12 by the clip formed with the beads 6, 7.

The clip shown in FIG. 4 is formed on the inside with approximately parallel longitudinal grooves or depressions 15. Thus between the grooves there are created elevated or raised portions or zones which improve the adhesion of the clip to the casing and function as the beads 6, 7 of FIGS. 1, 2 and 3.

The clip shown in FIG. 5 has both the beads 6 and 7 and the grooves 15. The grooves may be discontinuous as shown in FIG. 4*a*, being absent from the joinders between limbs and web or the grooves can be continuous, ismilar to the projections, in which case they will also be present even at the joinders between limbs and web.

The strip is preferably formed of aluminum and is from about 0.5 to 2 and preferably about 1 mm in thickness; greater thicknesses are unnecessarily wasteful. Lesser thicknesses do not permit displacement of material to form a bead. The strip width may be from about 3 to 10 mm, preferably about 4 to 5 mm. Narrower strips will put the beads too close together; a spacing of about 1.5 to 3.3 mm being satisfactory. The beads themselves are relatively sharp cornered to grasp material enclosed thereby but not so sharp as to cut it. The beads may range in height from about 0.2 to 1 and preferably about 0.3 mm above the top plane of the strip. To some extent it will depend upon the internal perimeter of the area enclosed by the closed clip which desirably is about 10 to 25 and preferably about 15 mm measured in the plane of the top of the strip; obviously the opening will be shorter measured along the top of the bead.

Because of the thickness of the strip relative to the height of the bead, coupled with the resistance of the strip material to deformation, the beads cannot be formed by making indentations in the reverse face. Were sufficient force provided so to form beads, they would be too round for good gripping and they would be too wide as well.

Viewed otherwise, to form a rib of a given height by pressing from the rear of a relatively thick strip will result in beads which are much wider on the gripping face. Since there must obviously be some space between the parallel beads this means the overall length of the strip material would have to be much longer than in the present invention. Not only does this result in waste of strip material but the sausage casing must obviously be longer as well so there are multiple economies resulting from beads formed as described hereinabove.

It will be appreciated that the instant specification is set forth by way of illustration and not limitation, and that various modifications and changes may be made without departing from the spirit and scope of the present invention.

I claim:

1. In a U-shaped clip made from substantially flat strip material and intended to close bags and flexible tubes, said clip comprising a web connecting two limbs having outwardly angled end lugs, the improvement which comprises providing on the surface of the clip which is to engage a bag a pair of spaced parallel beads extending longitudinally along the outer edges of the web and limbs, the material forming said beads being displaced inwardly from the outer longitudinal edges of the strip, and also providing in the surface of the clip which is to engage a bag a plurality of longitudinal parallel grooves in each limb and in the web, the grooves being discontinuous in that they are absent at the joinders between the limbs and web, the clip face opposite the grooved face being substantially flat, whereby such beads and grooves serve to grasp the bag more securely.

2. A clip according to claim 1, wherein the beads extend beyond the joinder between the limbs and connecting lugs.

3. A clip according to claim 1, wherein each connecting lug is dome-like in configuration.

4. A strip of clips according to claim 1, successively joined to one another at their lugs.

5. A clip according to claim 1, wherein the beads extend beyond the joinder between the limbs and connecting lugs and each connecting lug is dome-like in configuration, the clip being successively joined to like clips at their lugs to form an elongated strip from about 3 to 10 mm wide, each clip being of a length to form an enclosure of about 10 to 25 mm measured in the plane of the top of the strip.

6. In a U-shaped clip made from substantially flat strip material and intended to close bags and flexible tubes, said clip comprising a web connecting two limbs having outwardly angled end lugs, the improvement which comprises forming the surface of the clip which is to engage a bag so as to provide longitudinal parallel grooves in each limb and in the web with no grooves at the joinders between the limbs and web, the surface of the clip which is opposite the grooved face being substantially flat.

* * * * *